United States Patent [19]

Steinbicker et al.

[11] 4,073,701

[45] Feb. 14, 1978

[54] ACID ELECTROTINNING BATH

[75] Inventors: Richard N. Steinbicker, Coopersburg; Stewart E. Rauch, Bethlehem, both of Pa.

[73] Assignee: Bethlehem Steel Corporation, Bethlehem, Pa.

[21] Appl. No.: 732,821

[22] Filed: Oct. 15, 1976

[51] Int. Cl.[2] ..... C25D 3/32

[52] U.S. Cl. ..... 204/54 R

[58] Field of Search ..... 204/54 R, 43 S, 120, 204/54 L

[56] References Cited

U.S. PATENT DOCUMENTS

| | | | |
|---|---|---|---|
| 736,204 | 8/1903 | Buchner | 204/54 R X |
| 2,402,185 | 6/1946 | Schweikher | 204/54 R |
| 2,585,902 | 2/1952 | Gray | 204/54 R |
| 3,082,157 | 3/1963 | Francisco et al. | 204/54 R |
| 3,211,793 | 10/1965 | Roos | 260/577 |
| 3,230,159 | 1/1966 | Yonezaki et al. | 204/54 R |
| 3,453,186 | 7/1969 | Hause et al. | 204/54 R |
| 3,804,762 | 4/1974 | Jervis et al. | 252/50 |
| 3,850,765 | 11/1974 | Karustis et al. | 204/43 S |
| 3,919,269 | 11/1975 | Jaffe et al. | 260/404.5 |

FOREIGN PATENT DOCUMENTS

| | | | |
|---|---|---|---|
| 2,510,870 | 9/1975 | Germany | 204/43 S |

OTHER PUBLICATIONS

Frederick A. Lowenheim, "Modern Electroplating", pp. 374–379, (1963).

*Primary Examiner*—G. L. Kaplan
*Attorney, Agent, or Firm*—Joseph J. O'Keefe; Charles A. Wilkinson; John S. Simitz

[57] ABSTRACT

An improved acid halogen electrotinning bath composition for depositing a smooth, coherent layer of tin onto a steel substrate contains about 0.10 to 4.0 grams per liter of solution of at least one oxidation inhibiting agent comprising an organic ring compound which has a radical group such as $—NH_2$ or $—NO_2$ in the ortho or para position, for example para-aminoacetanilide and para-nitroacetanilide. Organic ring compounds, para-aminophenylacetic acid and 4-aminoantipyrine may also be added to the bath together with sodium ferrocyanide to inhibit the oxidation of the bivalent tin ions.

27 Claims, No Drawings

ACID ELECTROTINNING BATH

BACKGROUND OF THE INVENTION

Acid halogen electrotinning baths are designed to plate high quality tin deposits on steel sheet or strip at high current densities and high production rates. These baths generally have an anode efficiency of almost 100% and a cathode efficiency of about 85%. The baths are customarily formulated with halogen salts including stannous chloride, sodium chloride, sodium fluoride and sodium bifluoride. High concentrations of chlorides in the bath maintain maximum conductivity. Fluorides are complexing ions which stabilize the bivalent (stannous) tin ion by forming a complex sodium fluostannate II having the general formula $Na_2SnF_6$. The bivalent tin ions necessary for plating are supplied by tin anodes augmented by periodic additions of stannous chloride. The acidity of the bath is customarily maintained by periodic additions of hydrochloric acid.

The high speed of the steel sheet or strip in modern high production lines agitates the bath, resulting in air being dissolved or entrapped in the bath. The bivalent tin ion in the bath is oxidized by the oxygen in this air to the quadrivalent (stannic) tin ion in the form of a complex fluoride salt which is only slightly soluble in the bath, and is not suitable for plating. When the amount of salt in the bath exceeds its solubility in the plating bath, it is precipitated in the form of a complex fluoride salt sludge. The major constituent of the sludge is sodium fluostannate IV having the general formula $Na_4SnF_6$.

Metallic ions, such as ferrous iron and copper accelerate the oxidation of the bivalent tin ion. It is virtually impossible to prevent the presence of the iron ion in the bath since iron is introduced with the steel sheet or strip both by "drag-in" from the pickling baths and by dissolution from the steel sheet or strip in the acid plating bath. The bivalent (ferrous) iron ion introduced into the bath is also oxidized by the oxygen in the dissolved and entrapped air to the trivalent (ferric) iron ion. The trivalent iron ion is reduced to the ferrous iron ion in the bath. The reaction during the reduction of the trivalent iron ion to the bivalent iron ion accelerates the oxidation of the bivalent tin ion to the quadrivalent tin ion.

The oxidation of the bivalent tin ion reduces the amount of tin available for tinning purposes and significantly reduces the amount of soluble fluoride in the bath. As a consequence, frequent additions of stannous chloride and sodium fluoride and bifluoride must be made to the bath to maintain the concentration of the bath, thereby increasing chemical costs. The accumulation of large quantities of sludge in the tinning tanks makes it necessary to stop the plating line periodically so that the sludge can be removed from the bath. The sludge is removed manually. The termination of the plating operation is necessary for such removal and results in lost production time. Additionally, manual removal of the sludge is costly.

The sludge contains both tin and fluoride, and can be sold for a portion of the original value of the tin. The fluoride is a total loss since generally it is not recovered. The oxidation of the bivalent tin ion to the quadrivalent ion and the resulting formation of sludge is, therefore, costly in terms of lost production time, in loss of chemicals and in decreased tining efficiency.

It is naturally desirable to inhibit the oxidation of the bivalent tin ion to prevent the formation of the complex fluoride salt sludge and the accompanying decrease in efficiency of the plating bath. One prior art method for reducing the formation of sludge is to add sodium ferrocyanide to the bath to combine with the iron ions and form a very slightly soluble sodium ferrous ferrocyanide precipitate. The removal by precipitation of the iron from the bath reduces the amount of fluostannate IV sludge produced in a given time, but does not prevent the oxidation of the bivalent tin ion to the quadrivalent tin ion by oxygen dissolved or entrapped in the bath. Sodium ferrocyanide thus controls sludge formation by reducing the rate of oxidation of the bivalent tin ion but does not prevent the oxidation of the bivalent tin ion.

It is therefore the object of this invention to provide an improved acid halogen electrotinning bath which is less susceptible to oxidation and sludge formation than the baths now in use and in which the problems described above are alleviated.

SUMMARY OF THE INVENTION

It has been found that the oxidation of the bivalent tin ion in an acid halogen electrotinning bath containing bivalent tin ions can be greatly suppressed or in most cases virtually eliminated by adding a quantity of at least one organic ring compound which has a radical group such as $NH_2$ or $NO_2$ attached in the ortho or para position. Organic ring compounds which can be used are acetanilides, such as para-aminoacetanilide or para-nitroacetanilide. These ring compounds are maintained in a concentration of between 0.01 and 4.0 grams per liter of solution in the bath. Para-aminophenylacetic acid and 4-aminoantipyrine can be added to the bath and in the presence of sodium ferrocyanide reduce the rate of oxidation of the bivalent tin ion. Para-aminoacetanilide and para-nitroacetanilide can also be used in the presence of sodium ferrocyanide.

PREFERRED EMBODIMENT OF THE INVENTION

A substantially sludge-free acid halogen electrotinning bath for electrodepositing a smooth, bright, adherent, non-treeing, i.e. non-dendritic, film of tin onto a steel substrate, such as sheet or strip at high production levels, can be formulated by adding a small quantity of an organic ring compound; for example, acetanilides having either an amino group or a nitro group substituted in the para-position, for example, para-aminoacetanilide and para-nitroacetanilide. Organic ring compounds, such as para-aminophenylacetic acid and 4-amino antipyrine are also operative in the presence of sodium ferrocyanide. The bath conventionally contains stannous chloride, sodium fluoride and bifluorides, sodium chloride and other addition agents, which chemicals provide additional bivalent tin ions in addition to those supplied by tin anodes, fluoride ions, and chloride ions necessary for tinning. The acidity of the bath is maintained within a pH range of 2.5 to 4.5. Additionally, sodium ferrocyanide is usually added to the bath to remove iron ions from the bath as a complex sodium ferrous ferrocyanide precipitate which is only very slightly soluble in the bath.

The addition of an organic ring compound to the bath substantially reduces the oxidation of the bivalent tin ion to the quadrivalent tin ion thereby increasing the efficiency of the bath and decreasing operating costs. As noted above, acetanilides which can be added to the bath are para-aminoacetanilide (also referred to as PAA) and/or para-nitroacetanilide (also referred to as PNA). Other organic ring compounds which have been found to be useful are para-aminophenylacetic acid and 4-aminoantipyrine.

The structural formula of PAA and PNA are shown below:

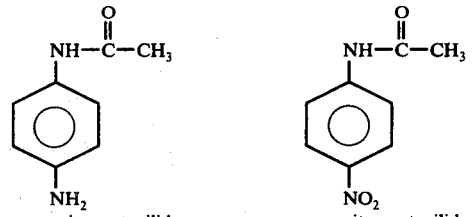

para-aminoacetanilide para-nitroacetanilide

We have found that by maintaining a concentration of para-aminoacetanilide, para-nitroacetanilide or mixtures thereof as low as 0.10 grams per liter or even less, that the oxidation rate of the bivalent tin ion can be reduced and controlled without impairing the efficiency of tinning and without periodic additions of stannous chloride to maintain the concentration of the bivalent tin ion. By maintaining concentrations of at least one of the acetanilides mentioned above, of between about 0 to 0.1 grams per liter of solution the oxidation of the bivalent tin ion can be suppressed and some benefits of the invention can be realized. However, the oxidation of the bivalent tin ion is not completely eliminated. As a result, some of the bivalent tin ions are still oxidized to the quadrivalent tin ion and sludge formation persists. If a larger concentration of the inhibiting agent of the invention is maintained in the bath, however, there will be less oxidation of the bivalent tin ion and less formation of sludge and, therefore, relatively more stannous tin available for plating. Consequently, no additions of stannous chloride to the bath will be required if sufficient inhibiting agent is used. As the concentration of the acetanilides increases from about 0.10 to 2.0 grams per liter of solution, the oxidation of the bivalent tin ion is increasingly suppressed until the oxidation is substantially eliminated. Concentrations of the acetanilide greater than 2.0, for example, up to 4.0 grams per liter of solution can be used, but the additional decrease in oxidation of the bivalent tin ion is negligible. Therefore, while concentrations of the acetanilide up to and even greater than 4.0 grams per liter of solution can be used to obtain the benefits of the invention, any additions to maintain these high concentrations are wasteful of chemicals. It is preferred to add a sufficient quantity of acetanilide to the bath to maintain a concentration of about 0.10 to 2.0 grams per liter of solution.

The oxidation of the bivalent tin ion to the quadrivalent tin ion can be reduced by more than 60% in the bath. As explained hereinafter, the oxidation of the bivalent tin ion to the quadrivalent tin ion was reduced by about 60% in a laboratory formulated bath when a 100% oxygen atmosphere was bubbled through the bath. Since the atmosphere dissolved and entrapped in a working bath is air, only one-fifth as much oxygen as in the laboratory bath is available to oxidize the bivalent tin ion in a working bath. Hence, the suppression of oxidation of the bivalent tin ion in a commercial tin plating bath will be normally greater than 60% which is quite sufficient to prevent the formation of any significant amount of sludge. The anode efficiency in the bath under these circumstances is substantially 100% and the cathode efficiency is at least about 85%, hence an excessive buildup of bivalent tin ions could occur. Consequently, it may actually be necessary if a complete absence of sludge is desired, to take steps to prevent an excessive buildup of bivalent tin in the bath, such as, for example, by continuously or periodically removing a portion of the plating solution and either precipitating some of the bivalent tin or otherwise adjusting the solution to lower the concentration of the bivalent tin ion. The adjusted plating solution may then be returned to the plating tanks. Normally, however, in modern high speed plating lines there will be sufficient drag-out and other loss from the plating tanks to prevent buildup of excessive amounts of the bivalent tin ion even in the complete absence of oxidation.

The para-nitroacetanilide appears to be more effective than para-aminoacetanilide at concentrations of 0.5 to 2.0 grams per liter of solution. However, the para-nitroacetanilide in the presence of the bivalent tin ion is converted to para-aminoacetanilide. Para-aminoacetanilide is very soluble in the bath whereas high bath temperatures are needed to dissolve the para-nitroacetanilide. It is therefore preferred to use para-aminoacetanilide.

We have found unexpectedly that para-aminoacetanilide is effective in preventing the oxidation of the bivalent tin ion whether the iron ion is or is not present in the bath. As noted previously, the presence of the iron ion in the bath accelerates the oxidation of the bivalent tin ion. Neutralization, or rather stabilization, of the ferrous iron ion in the bath will decrease the rate of oxidation of the bivalent tin ion. Sodium ferrocyanide added to the bath sequesters and stabilizes the ferrous iron ion. However, the iron ion in the form of a slightly soluble precipitate of sodium ferrous ferrocyanide is still in an active state and can accelerate the oxidation of the bivalent tin ion. The oxidation of the bivalent tin ion and the formation of the slightly soluble precipitate sodium fluostannate IV do occur, but at a reduced rate. The addition of an organic ring compound, such as para-aminophenylacetic acid or 4-aminoantipyrine to the acid halogen bath does retard the oxidation of the bivalent tin ion in the presence of sodium ferrocyanide, but does not retard the oxidation of the bivalent tin ion in the absence of the sodium ferrocyanide. However, para-aminoacetanilide does prevent the oxidation of the bivalent tin ion whether sodium ferrocyanide is present or not.

It is postulated that para-aminoacetanilide in the absence of the complex sodium ferrous ferrocyanide reduces the reactivity of the oxygen in the bath, thereby reducing the oxidation of the bivalent tin ion. In the presence of the iron ion, the para-aminoacetanilide also sequesters and stabilizes the iron ion. When sodium ferrocyanide is added to the bath sodium ferrous ferrocyanide is formed. The ferrous ferrocyanide complex is chemically reactive and can undergo oxidation-reduction reactions which accelerate the oxidation of the bivalent tin ion. At high pH levels in the bath (3.8 and above) the para-aminoacetanilide complexes with ferrous ferrocyanide forming a compound loosely bound to the para-aminoacetanilide through a ligands exchange reaction. The para-aminoacetanilide which exists as the anilinium ion form replaces one of the $CN^-$ ligands of the ferrocyanide to form [FeII $(CN)_5$ para-aminoacetanilide]$^{-3}$. Oxygen dissolved or entrapped in the bath is not capable of oxidizing [FeII $(CN)_5$ para-aminoacetanilide] to [FeIII $(CN)_5$ para-aminoacetanilide]$^{-2}$. Therefore, the amount of trivalent iron complex in the bath is extremely small and the oxidation of the bivalent tin ion is decreased considerably. The trivalent iron complex is the part of the oxidation-reduction reaction in the bath which causes the oxidation of the bivalent tin ion.

Para-aminoacetanilide sequesters uncombined iron ions without undergoing the ligand exchange reaction, by forming a covalent coordinate complex. Thus, the iron ion is not able to accelerate the oxidation of the bivalent tin ion. Adding sodium ferrocyanide to the bath provides an additional sequestering agent to stabilize the ferrous iron ion which may be present to form the solid precipitate, sodium ferrous ferrocyanide. Stabilizing the ferrous iron ion increases the effectiveness of para-aminoacetanilide. The effectiveness of adding the two agents, sodium ferrocyanide and para-aminoacetanilide, is additive. The bivalent tin ion remains virtually unaffected in the bath and substantially all the bivalent tin ion added to the bath as stannous chloride or from the solid tin anodes is available to be plated onto the steel sheet or strip. The soluble fluoride salts remain available to solubilize and stabilize the tin in the bath. Additions of stannous chloride and fluorides and chlorides are kept to a minimum. The efficiency of the bath is maximized. The above explanation is by way of theory only and we do not wish to be held thereto.

While a concentration of at least 0.01 to 0.10 gram per liter of solution of the organic ring compounds in the bath reduces the oxidation of the bivalent tin ion, concentrations of about 2.0 grams per liter of solution decrease the oxidation of the bivalent tin ion to a very low level. Concentrations above 2.0 grams per liter of solution do not significantly decrease the oxidation of the bivalent tin ion, but some reduction of oxidation does occur. Hence, it is wasteful of an expensive chemical to add more of the organic ring compound than is necessary to maintain a concentration of about 2.0 grams per liter of solution. However, the addition of up to 4.0 grams per liter is effective for oxidation inhibition even though wasteful with respect to organic ring compound.

By an organic ring compound we mean an aromatic organic compound having the general structure shown below:

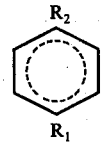

where $R_1$ is an amino group $—NH_2$ or a nitro group $—NO_2$ and $R_2$ can be a substituted amine group

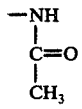

an acid group $—CH_3COOH$ or pyrine group

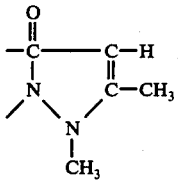

In an example of the effectiveness of para-aminoacetanilide as an oxidation inhibiting reagent, an acid halogen electrotinning bath was made to the following composition:

| Reagents | Quantities In the Bath (Grams Per Liter) |
|---|---|
| Stannous Chloride | 54.0 |
| Sodium Fluoride | 47.3 |
| Sodium Chloride | 39.8 |
| Sodium Bifluoride | 47.3 |
| Sodium Ferrocyanide | 1.5 |
| Addition Agents | 7.9 |

The ion concentrations in the bath in grams per liter are shown below:

| | |
|---|---|
| $Sn^{+2}$ | 33.2 |
| $Sn^{+4}$ | 0.4 |
| $\Sigma Sn$ | 33.6 |
| $F^-$ | 26.8 |
| $Cl^-$ | 50.2 |
| $[Fe(CN_6)]^{-4}$ | 0.33 |

The pH of the bath was 3.2.

To insure the presence of complex ferrocyanides in the bath, 1.25 grams of ferrous sulfate ($FeSO_4.7H_2O$) and 1.1 grams of sodium ferrocyanide ($Na_4[Fe(CN)_6].10H_2O$) per liter of solution were added to the bath.

The bath was divided into aliquot lots. The aliquot lots were heated to 131° F. (55° C.), 150° F. (65° C.) and 167° F. (75° C.). Various amounts of p-aminoacetanilide were added to the aliquot lots. Chemically pure oxygen was bubbled through each lot for about 180 minutes to oxidize the bivalent tin ion. The solutions were analyzed every thirty minutes to determine the degree of oxidation of the bivalent tin ion over a period of time.

The addition of 2.0 grams per liter of solution of para-aminoacetanilide decreased the rate of oxidation of the bivalent tin ion by about 65% at the operating temperatures. The addition of 0.5 grams per liter of solution of para-aminoacetanilide also decreased the rate of oxidation of the bivalent tin ion, but to a lesser degree. The results of the oxidation tests are shown below:

Rate of Oxidation of Bivalent Tin in an Acid Halogen Bath Containing a Concentration of Para-Aminoacetanilide With Respect to Time

| Solution Temperature | Rate of Oxidation Per Minute of Tin at Various Concentrations of PAA (Grams Per Liter) 0 | 0.5 | 1.0 | 2.0 | 4.0 |
|---|---|---|---|---|---|
| 131° F (55° C) | 0.0695 | 0.0431 | 0.0346 | 0.0245 | 0.0237 |
| 150° F (65° C) | 0.0840 | 0.0616 | 0.0484 | 0.0375 | 0.0315 |
| 167° F (75° C) | 0.0941 | 0.0721 | 0.0590 | 0.0433 | 0.0450 |

In a further example of the invention, a commercial acid halogen electrotinning bath was formulated to plate steel strip with a coating of one quarter of a pound of tin per base box at an average speed of 1750 feet per minute. The bath was sampled at two-hour intervals for a period of four weeks. Seven additions of para-aminoacetanilide were made to the bath which had a volume of about 15,000 gallons over an operating span of four weeks. The chemical composition of the bath prior to any addition of para-aminoacetanilide and after each of the seven additions and the amount of the additions are shown below in Table #1.

Table #1

| Chemical | Grams per Liter | | | | | | | |
|---|---|---|---|---|---|---|---|---|
| | None | 1st* | 2nd* | 3rd* | 4th* | 5th* | 6th* | 7th* |
| ΣSn | 15.69 | 27.34 | 29.13 | 33.39 | 35.41 | 34.36 | 43.77 | 44.37 |
| $Sn^{+2}$ | 8.22 | 14.94 | 17.33 | 20.09 | 24.05 | 25.10 | 32.79 | 33.09 |
| $Sn^{+4}$ | 7.47 | 12.40 | 11.80 | 13.30 | 11.35 | 9.26 | 10.98 | 11.28 |
| $F^-$ | 23.61 | 35.48 | 36.90 | 37.87 | 41.46 | 41.53 | 46.24 | 50.42 |
| $Cl^-$ | 18.82 | 18.75 | 17.11 | 16.06 | 12.55 | 12.92 | 11.06 | 10.76 |
| Cyanide** | 4.5 | 5.4 | 3.9 | 3.8 | 1.5 | 2.8 | 2.4 | 1.9 |
| PAA | .26 | .40 | .75 | .88 | 1.00 | 1.26 | .91 | 1.66 |

*1st, 2nd and 3rd additions were 25 pounds; 4th, 5th and 6th additions were 50 pounds; 7th addition was 150 pounds.
**Cyanide is reports as $Na[Fe(CN_6)]\ 10H_2O$ The bath operated at an average current density of 450 A/SF, an average temperature of 145° F. (65° C.), and a pH within the range of 3.0–4.2. The overall ranges in the concentration of the materials in the bath over the four week period are listed below:

| | Gm. Per Liter |
|---|---|
| ΣSn | 15.68 to 46.15 |
| $Sn^{+2}$ | 8.21 to 36.89 |
| $Sn^{+4}$ | 6.52 to 13.44 |
| $F^-$ | 23.59 to 55.78 |
| $Cl^-$ | 8.59 to 19.19 |
| $[Fe(CN)_6]^4$ | 0.5 to 3.5 |
| para-aminoacetanilide | 0.26 to 2.06 |

The average concentration of para-aminoacetanilide over a four week period of operation was 0.86 gram per liter. Virtually no sludge was formed. Sludge which formed during the beginning of the operation prior to the addition of para-aminoacetanilide was dissolved. The oxidation of the complex ferrous ferrocyanide was completely retarded. This was evident from the color of the bath. Normally the presence of the oxidized species sodium ferrous ferrocyanide is indicated by an intense blue color. After adding para-aminoacetanilide to the bath, the color of the bath reverted to gray and remained gray in color, indicating the presence of the reduced species sodium ferrous ferrocyanide.

During the operation the bath, which had a concentration of 8.2 grams of bivalent tin ion per liter of solution when made up, actually increased to a concentration of about 30.0 grams of bivalent tin ion per liter of solution at the end of four weeks of operation.

The concentration of the para-aminoacetanilide is determined by a color test in which the para-aminoacetanilide was reacted with phenol. The intensity of the blue color developed by the reaction was measured colorimetrically.

In another example of the invention, three additions each of eighteen pounds of para-aminoacetanilide were made at about twenty-four hour intervals to a working acid halogen electrotinning bath containing 22,000 gallons of solution. Steel strip was tinned at a rate of about 1750 feet per minute. Various thicknesses of tin from about ¼ pound per base box to one pound per base box were applied to the steel. A chemical analysis of the bath was made prior to any additions and about twenty hours after each addition of para-aminoacetanilide. The results of the analyses are tabulated below in Table #2:

TABLE #2

| Chemical | Grams per Liter | | | |
|---|---|---|---|---|
| | None | 1st addition | 2nd addition | 3rd addition |
| ΣSn | 18.99 | 20.92 | 23.16 | 26.15 |
| $Sn^{+2}$ | 10.46 | 11.21 | 12.99 | 16.14 |
| $Sn^{+4}$ | 8.51 | 9.71 | 10.15 | 10.01 |
| $F^-$ | 26.14 | 28.38 | 27.94 | 28.83 |
| $Cl^-$ | 19.42 | 21.21 | 20.17 | 19.42 |
| Cyanide* | 3.2 | 2.3 | 3.1 | 3.1 |
| PAA | 0 | 0.11 | 0.19 | 0.29 |

*Cyanide is reported as $Na_4[Fe(CN_6)]\ 10H_2O$

The bath was operated for six days after the third addition of para-aminoacetanilide. A chemical analysis of the bath was made at the start of each turn that the bath was operated. The average range of concentrations in the bath over the period of six days as determined by the chemical analyses is shown below:

| Average Composition of Bath | |
|---|---|
| Chemical | Grams Per Liter |
| ΣSn | 24.20 to 29.13 |
| $Sn^{+2}$ | 15.01 to 17.18 |
| $Sn^{+4}$ | 7.77 to 11.95 |
| $F^-$ | 26.89 to 30.63 |
| $Cl^-$ | 18.68 to 21.89 |
| $[Fe(CN)_6]^{-4}$ | 2.50 to 3.50 |
| PAA | 0.23 to 0.33 |

The bath was operated at an average temperature of 60° C (140° F.) and an average pH of 3.9.

An increase in the concentration of para-aminoacetanilide brought about by the three additions to the bath resulted in an increase and stabilization of the bivalent tin ion in the bath. The oxidation rate of the bivalent tin ion was therefore controlled by the additions of the para-aminoacetanilide. No additions of stannous chloride were needed to increase the concentration of the bivalent tin ion required for efficient plating. All the bivalent tin ions were provided by the tin anodes. The oxidation of the bivalent tin ions was suppressed but not completely eliminated at the concentration of para-aminoacetanilide in the bath.

We claim:

1. An improved aqueous acid halogen electrotinning bath for electrolytically depositing tin onto a steel substrate, containing bivalent tin ions, sodium fluoride, sodium chloride, stabilizing and solubilizing agents, addition agents for electrodepositing a smooth coherent layer of tin onto said substrate and at least about 0.10 grams per liter of solution of at least one acetanilide taken from the group consisting of para-aminoacetanilide and para-nitroacetanilide, said bath being characterized by having reduced susceptibility of the bivalent tin ion to oxidation to the quadrivalent tin ion.

2. The improved aqueous acid halogen electrotinning bath of claim 1 wherein said acetanilide is present in amounts of about 0.10 to 2.0 grams per liter.

3. The improved aqueous acid halogen electrotinning bath of claim 1 wherein said acetanilide is present in amounts of about 0.10 to 4.0 grams per liter.

4. The improved aqueous acid halogen electrotinning bath of claim 1 wherein said acetanilide is para-aminoacetanilide.

5. The improved aqueous acid halogen electrotinning bath of claim 1 wherein said acetanilide is para-nitroacetanilide.

6. An improved aqueous acid halogen electrotinning bath for electrolytically depositing tin onto steel sheet and strip containing bivalent tin ions, sodium fluoride, sodium bifluoride, sodium chloride, sodium ferrocyanide, addition agents necessary to deposit a smooth, coherent layer of tin onto said steel sheet and strip and at least about 0.10 gram per liter of solution of at least one organic ring compound containing at least one radical taken from the group consisting of the amino group, $—NH_2$, and the nitro group, $—NO_2$, in the ortho or para position, said organic ring compound taken from the group consisting of para-aminoacetanilide, para-nitroacetanilide, para-aminophenylacetic acid and 4-aminoantipyrine.

7. The improved aqueous acid halogen electrotinning bath of claim 6 in which the organic ring compound is para-aminoacetanilide.

8. The improved aqueous acid halogen electrotinning bath of claim 6 in which the organic ring compound is para-nitroacetanilide.

9. The improved aqueous acid halogen electrotinning bath of claim 6 in which the organic ring compound is para-aminophenylacetic acid.

10. The improved aqueous acid halogen electrotinning bath of claim 6 in which the organic ring compound is 4-aminoantipyrine.

11. An improved aqueous acid halogen electrotinning bath for electrolytically depositing a smooth, coherent layer of tin onto at least one surface of a steel substrate containing bivalent tin ions and at least about 0.10 gram per liter of solution of at least one acetanilide taken from the group consisting of para-aminoacetanilide and para-nitroacetanilide.

12. An improved aqueous acid halogen electrotinning bath as claimed in claim 11 wherein the concentration of the acetanilide in the bath is about 0.10 to 2.0 grams per liter of solution.

13. An improved aqueous acid halogen electrotinning bath as claimed in claim 11 wherein said acetanilide is present in amounts of about 0.10 to 4.0 grams per liter of solution.

14. An improved aqueous acid halogen electrotinning bath as claimed in claim 11 wherein said acetanilide is para-aminoacetanilide.

15. An improved aqueous acid halogen electrotinning bath as claimed in claim 11 wherein said acetanilide is para-nitroacetanilide.

16. A method for inhibiting the oxidation of the bivalent tin ion in an aqueous acid halogen electrotinning bath including adding an amount of at least one organic ring compound taken from the group consisting of para-aminoacetanilide and para-nitroacetanilide to the bath to maintain at least about 0.10 gram per liter of solution of said organic ring compound in the bath.

17. The method as claimed in claim 16 wherein the amount of the organic ring compound added to the aqueous bath is sufficient to maintain a concentration of said organic ring compound in the bath at about 0.10 to 2.0 grams per liter of solution.

18. The method as claimed in claim 16 wherein the amount of the organic ring compound added to the aqueous bath is sufficient to maintain a concentration of said organic ring compound of about 0.10 to 4.0 grams per liter of solution.

19. The method as claimed in claim 16 wherein the organic ring compound is para-aminoacetanilide.

20. The method as claimed in claim 16 wherein the organic ring compound is para-nitroacetanilide.

21. An improved aqueous acid halogen electrotinning bath for electrolytically depositing tin onto a steel substrate, containing bivalent tin ions, sodium fluoride, sodium chloride, sodium ferrocyanide, stabilizing and solubilizing agents, addition agents for electrodepositing a smooth coherent layer of tin onto said substrate and at least about 0.10 gram per liter of solution of at least one organic ring compound taken from the group consisting of para-aminoacetanilide, para-nitroacetanilide, para-aminophenylacetic acid and 4-aminoantipyrine, said bath being characterized by having reduced susceptibility to oxidation of the bivalent tin ion.

22. The improved aqueous acid halogen electrotinning bath of claim 21 wherein said organic ring compound is present in amounts of about 0.10 to about 2.0 grams per liter of solution.

23. The improved aqueous acid halogen electrotinning bath of claim 21 wherein said organic ring compound is present in an amount of about 0.10 to 4.0 grams per liter of solution.

24. The improved aqueous acid halogen electrotinning bath of claim 21 wherein said organic ring compound is para-aminoacetanilide.

25. The improved aqueous acid halogen electrotinning bath of claim 21 wherein said organic ring compound is para-nitroacetanilide.

26. The improved aqueous acid halogen electrotinning bath of claim 21 wherein said organic ring compound is para-aminophenylacetic acid.

27. The improved aqueous acid halogen electrotinning bath of claim 21 wherein said organic ring compound is 4-aminoantipyrine.

* * * * *